US006345768B1

(12) United States Patent
Inagaki et al.

(10) Patent No.: US 6,345,768 B1
(45) Date of Patent: Feb. 12, 2002

(54) CONTROL VALVE FOR VESSEL GAS WATER HEATER

(75) Inventors: Hideo Inagaki; Atsushi Tanahashi, both of Nagoya (JP)

(73) Assignee: Paloma Industries, Limited (JP)

( * ) Notice: Subject to any disclaimer, the term of this patent is extended or adjusted under 35 U.S.C. 154(b) by 0 days.

(21) Appl. No.: 09/584,460

(22) Filed: May 31, 2000

(30) Foreign Application Priority Data

Jun. 3, 1999 (JP) ..... 11-156319

(51) Int. Cl.[7] ..... F23N 1/00

(52) U.S. Cl. ..... 236/15 A; 431/51; 431/53

(58) Field of Search ..... 236/21 R, 26 A, 236/15 A, 68 D; 431/51, 53, 54

(56) References Cited

U.S. PATENT DOCUMENTS 3,402,887 A * 9/1968 Visos ..... 236/21 R
3,915,378 A * 10/1975 Kinsella et al. ..... 236/15 A
5,967,776 A * 10/1999 Katchka ..... 236/21 R

* cited by examiner

*Primary Examiner*—William E. Tapolcai
*Assistant Examiner*—Mohammad M. Ali
(74) *Attorney, Agent, or Firm*—Pearson & Pearson, LLP

(57) ABSTRACT

A control valve for a vessel gas water heater includes a single governor for controlling a wider range of the flow of gas from pilot supply to main supply.

Once an ignition knob 1 is pressed and turned to open the magnetic valve $V_1$ and ignite the pilot burner PB, the magnetic valve $V_1$ is maintained open by the electromotive force of a thermocouple TC heated by a pilot flame c. When the ignition knob 1 is released from being pressed, and turned further to open the plunger valve $V_3$, the boiler is shifted to the standby state for enabling the supply of gas to the main burner MB. Meanwhile, a sensor rod B is mounted in a reservoir A for contracting and expanding depending on the temperature of the hot water in the reservoir A to open and close the snap valve $V_5$, thus controlling the combustion and its cancellation in the main burner MB. Accordingly, the temperature of the hot water in the reservoir A can automatically be controlled in the vessel gas water heater. In particular, a single governor is provided in which the seat tightness between its valve $V_4$ and valve seat is improved with the use of at least a rubber molding 17*a* and the gas valve $V_4$ is prevented from tilting by a guide pin 20 freely fitted in a shaft 18 of the valve, thus controlling the flow of gas to the main burner MB and to the pilot burner PB for a wider range from main supply to pilot supply.

7 Claims, 2 Drawing Sheets

CONTROL VALVE FOR VESSEL GAS WATER HEATER

BACKGROUND OF THE INVENTION

1. Field of the Invention

The present invention relates to a control valve for a constantly pilot flaming type vessel gas water heater in which the temperature of hot water in a reservoir can automatically be controlled to a desired level.

2. Description of the Related Art

Such a conventional control valve for a vessel gas water heater has, for example, a main burner governor valve unit MGV' provided across a main gas passage and a pilot burner governor valve unit PGV' provided across a pilot gas passage as shown in FIG. 3. The main burner governor valve unit MGV' is arranged in that, when not in use, its gas valve $V_4'$ is lifted and closed by the action of a taper cam 2*a*', which is mounted to the distal end of an ignition operating shaft 2' linked integral with an ignition knob 1', pressing via a link lever 30' together with a diaphragm 15' as resisting against the yielding force of an adjusting spring 16'. The pilot burner governor valve unit PGV' comprises a diaphragm 15", a gas valve $V_4''$, and an adjusting spring 16".

For starting the ignition, the ignition knob 1' is turned from the "stop" position to the "pilot" position and then depressed by one stroke, hence activating the ignition operating shaft 2' to push and open the magnetic valve $V_1'$ of a safety solenoid valve unit MV'. This allows the gas to run from a gas inlet 5*a*' via the pilot burner governor valve unit PGV' mounted across the gas passage to the pilot burner PB'. As the gas is ignited by a match or lighter, a pilot flame c' is produced thus maintaining the magnetic valve $V_1'$ open. At the time, the gas valve $V_4'$ of the main burner governor valve unit MGV' remains closed. Then, the ignition knob 1' is released from being pressed and turned further from the "pilot" position to the "open" position. As a result, the lifting and closing of the gas valve $V_4'$ of the main burner governor valve unit MGV' by the taper cam 2*a*' of the ignition operating shaft 2' is canceled. Once the gas valve $V_4'$ is freed and open, it then acts as a governor valve in cooperation with the diaphragm 15'.

Since the magnetic valve $V_1'$ serves as a plunger valve, it requires an extra mechanism for being forced to the closing position, which is implemented by a switch S' provided in an electromagnetic circuit to disconnect the safety solenoid valve unit MV' from the power supply. Only when the ignition knob 1' is turned to the "stop" position, the switch S' is switched off to close the magnetic valve $V_1'$.

When the temperature of hot water in a reservoir A' is lower than a desired level, the action of a sensor rod B' drives a snap lever 23' to move a snap disk 25' to the opposite position, thus opening a snap valve $V_5'$ to supply a flow of gas to the main burner. The gas is then ignited by the pilot flame c' hence increasing the temperature of the hot water in the reservoir A' to the desired level. As the hot water in the reservoir A' reaches the desired temperature, it is sensed by the sensor rod B' which in turn moves back the snap disk 25' to the original position (at the standby state) Simultaneously, the snap valve $V_5'$ is closed to extinguish the flame of the main burner providing the standby state. Denoted by F' is a thermal fuse provided in the electromagnetic circuit and 28' is a temperature setting screw which supports the proximal end of the snap lever 23'. Also shown is a pilot filter 31'.

However, the conventional control valve described above includes the main burner governor valve unit MGV' and the pilot burner governor valve unit PGV', incorporating a two-governor system. Therefore, its structure will be complicated and its overall size will hardly be minimized, hence increasing the production cost.

Also, the electromagnetic circuit contains the electric switch S' and the thermal fuse F', permitting the resistance to increase with time. As the resistance increases in the electromagnetic circuit, the current will proportionally be declined.

SUMMARY OF THE INVENTION

It is thus an object of the present invention to provide a control valve for a vessel gas water heater having a single governor provided for controlling the flow of gas for a wider range from pilot supply to main supply thus to eliminate the foregoing problems as of the prior art.

As defined in claim 1 of the present invention for solving the above problems, a control valve for a vessel gas water heater is provided having an ignition knob pressed and turned for opening the magnetic valve and igniting the pilot burner, the magnetic valve maintained open by the electromotive force of a thermocouple heated with a pilot flame, and then, the ignition knob released from being pressed and turned further for opening the plunger valve to enable the supply of gas to the main burner, and having a sensor rod for contracting and expanding depending on the temperature of hot water in a reservoir to open and close the snap valve and thus proceed and cancel the combustion in the main burner for automatically controlling the temperature of the hot water in the reservoir to a desired level, characterized by a single governor valve unit arranged in that the positional relationship between its valve and valve seat is correctly maintained to have a wide range of the flow of gas from a pilot supply to a main supply, thus enabling stable control over both the flow of gas to the main burner and the flow of gas to the pilot burner.

As defined in claim 2 of the present invention, the control valve for a vessel gas water heater according to claim 1 may be modified in which the governor valve is also arranged in that the interfacial accuracy between the valve and the valve seat is improved and the valve is prevented from tilting.

As defined in claim 3 of the present invention, the control valve for a vessel gas water heater according to any of claims 1 and 2 may be modified in which the valve seat for the valve is increased in the seating tightness using a rubber molding and fine polishing.

As defined in claim 4 of the present invention, the control valve for a vessel gas water heater according to any of claims 1 and 2 may be modified in which the valve is prevented from tilting by a guide pin freely fitted in a shaft of the valve.

As defined in claim 5 of the present invention, the control valve for a vessel gas water heater according to claim 1 may be modified in which the pilot burner is a constantly flaming type pilot burner designed for also heating a thermocouple.

The control valve for a vessel gas water heater defined in claim 1 of the present invention, which is arranged in that the ignition knob is pressed and turned for opening the magnetic valve and igniting the pilot burner, the magnetic valve is maintained open by the electromotive force of the thermocouple heated with the pilot flame, and then the ignition knob is released from being pressed, and turned further for opening the plunger valve to enable the supply of gas to the main burner and thus set the standby state while the sensor rod is provided for contracting and expanding depending on the temperature of hot water in the reservoir to open and close the snap valve and thus proceed and cancel the combustion in the main burner for automatically controlling the temperature of the hot water in the reservoir to a desired level, is characterized by the single governor valve unit arranged in that the positional relationship between its valve and valve seat is correctly maintained so that the supply of the gas is constantly flown corresponding to the requirement for the pilot supply and the main supply which ranges widely from the pilot supply to the main supply. As a result, the control valve of the present invention will be simplified in the construction and reduced in the production cost as compared with any conventional two-governor type.

The control valve for a vessel gas water heater defined in claim 2 of the present invention has the governor valve arranged in that the interfacial accuracy between the valve and the valve seat is improved and the valve is prevented from tilting, hence allowing the single governor valve unit to control throughout a wider range of the flow of the gas from the pilot supply to the main supply. Accordingly, the control valve defined in claim 1 can be implemented with much ease.

The control valves for a vessel gas water heater defined in claims 3 and 4 are arranged in which the valve seat for the valve is increased in the seating tightness using the rubber molding and the fine polishing and in which the valve is prevented from tilting by the guide pin freely fitted in the shaft of the valve, hence allowing the positional relationship between the valve and the valve seat to be correctly maintained. Accordingly, the control valve defined in claim 1 or 2 can be implemented with much ease.

The control valve for a vessel gas water heater defined in claim 5 is modified in which the pilot burner is a constantly flaming type pilot burner designed for also heating the thermocouple, allowing the magnetic valve to be closed by extinguishing the pilot flame. Accordingly, such a disadvantage that the electromagnetic force is declined due to the increase with time of the resistance in the magnetic circuit equipped with an electric switch can be eliminated thus improving the operational reliability.

DETAILED DESCRIPTION OF THE PREFERRED EMBODIMENTS

Preferred embodiments of a control valve for a vessel gas water heater of the present invention will be described to clarify the arrangement and effect of the present invention, referring to the relevant drawings.

Figure 1:
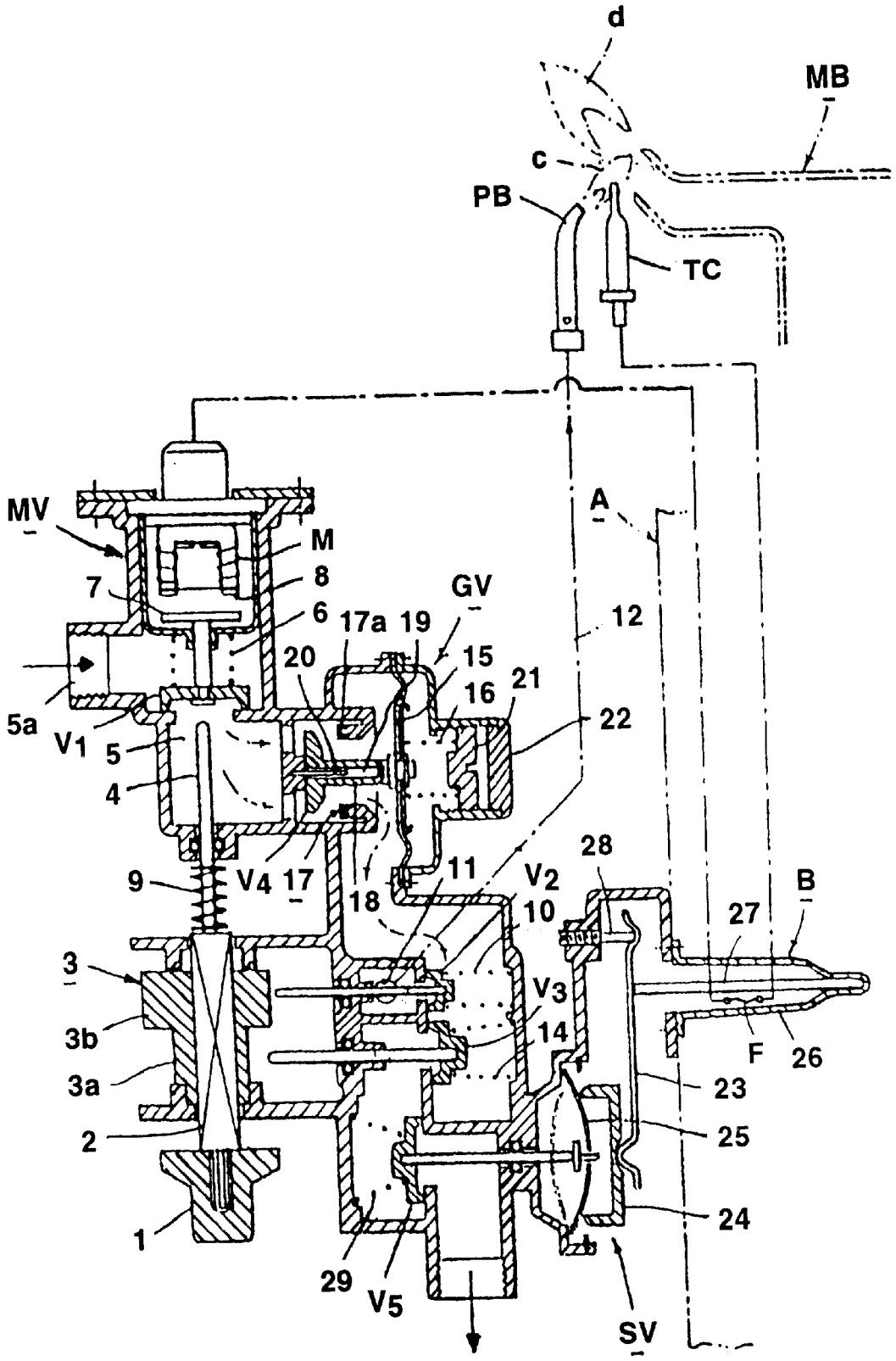
FIG. 1 is a schematic extensive cross sectional view illustrating one embodiment of a control valve for a vessel gas water heater according to the present invention.
Figure 2:
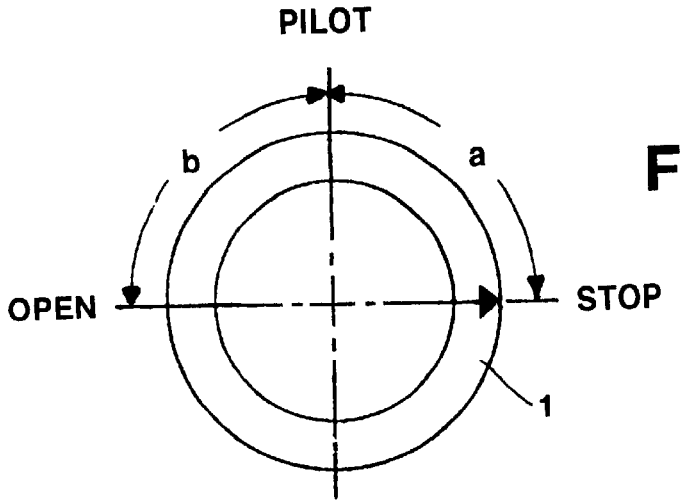
FIG. 2 is a front view of an exemplary turning operation of an ignition knob.
Figure 3:
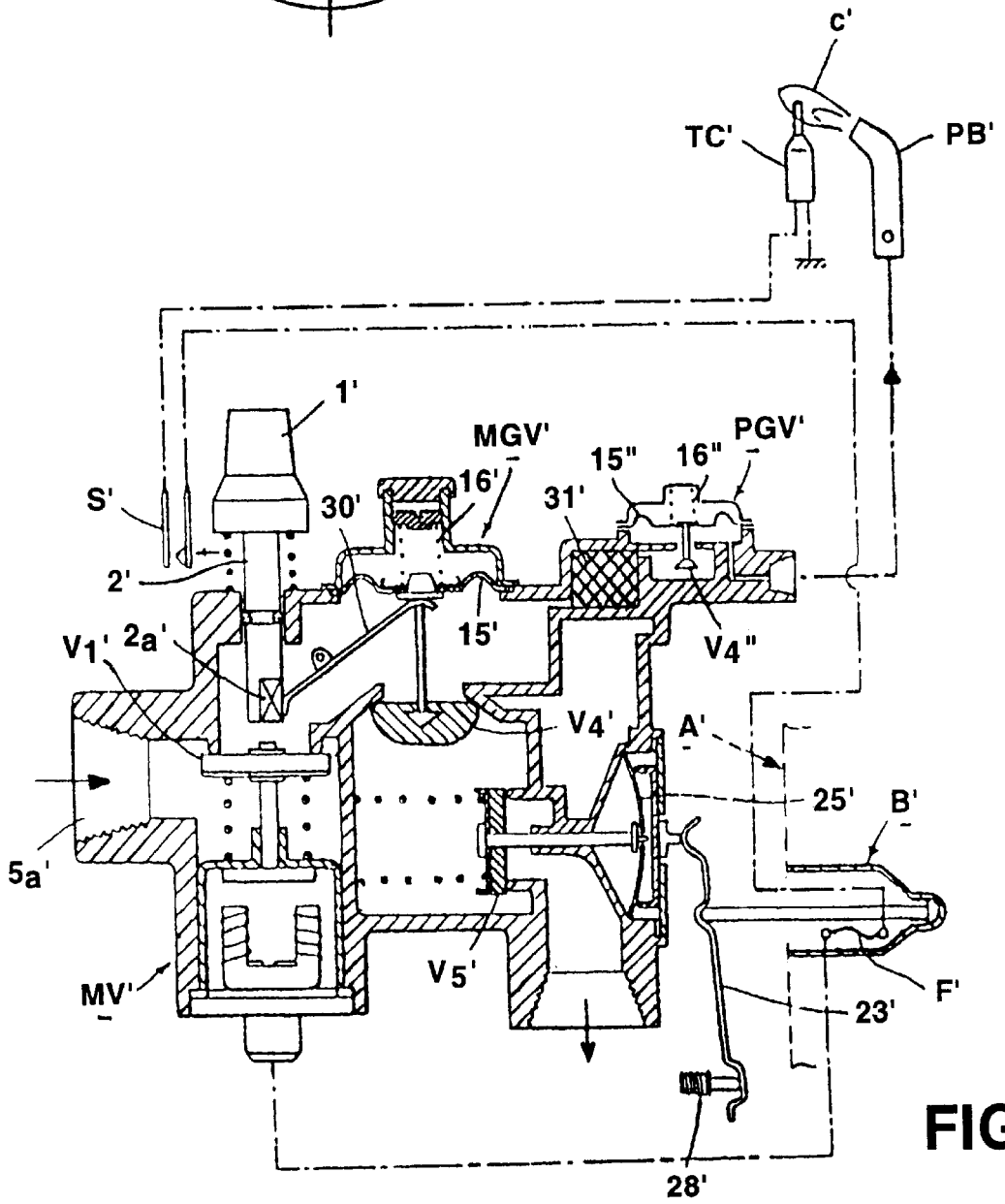
FIG. 3 is a schematic extensive cross sectional view illustrating a conventional control valve of such a type.

As shown in FIGS. 1 and 2, denoted by 1 is an ignition knob which is pressed once to open a magnetic valve $V_1$ and ignite a pilot burner PB. More specifically, the ignition knob 1 is arranged integral with an ignition operating shaft 2 on which a cam body 3 comprising a plunger valve cam 3*a* and a pilot valve cam 3*b* is fixedly mounted for turning motion. The ignition operating shaft 2 has a distal end extension 4 thereof extending along the axis of the ignition operating shaft 2 for engaging with a safety solenoid valve unit MV provided at the upstream of a gas passage 5.

The safety solenoid valve unit MV is adapted in which the magnetic valve $V_1$ is urged by a spring 6 to the closed state and an attraction plate 7 linked integrally with the magnetic valve $V_1$ sits opposite to an attraction side 8 of a solenoid M for moving directly to and from the same. The distal end extension 4 of the ignition operating shaft 2 is located so that it can engage directly with and disengage from the magnetic valve $V_1$ along the common axial direction of the magnetic valve $V_1$ of the safety solenoid valve unit MV. The ignition operating shaft 2 with the distal end extension 4 remains urged by a spring 9 to the return state (in the backward direction).

When the ignition knob 1 is pressed in the axial direction by a given stroke against the urging force of the return spring 9 along the axial direction, it presses and opens the magnetic valve $V_1$ with distal end extension 4 and simultaneously drives the attraction plate 7 linked to the magnetic valve $V_1$ to move directly to the attraction side 8 of the solenoid M. Then, when the ignition knob 1 being pressed is turned from the "stop" position to the "pilot" position throughout a predetermined angle a (about 90 degrees) counter-clockwisely, the cam body 3 on the ignition operating shaft 2 rotates to open the pilot valve $V_2$ with its pilot valve cam 3*b* pressing against the urging force of a closing spring 10, allowing a flow of gas controlled to a desired pressure by a governor valve unit GV, described later, to be introduced from a gas inlet 5*a* of the gas passage 5 to the pilot burner PB via the pilot valve $V_2$, a pilot gas inlet 11, and a pilot gas passage 12. When the pilot burner PB is ignited using a match or lighter, a pilot flame c appears in the pilot burner PB.

As the pilot burner PB is ignited, the pilot flame c heats up a thermocouple TC thus to keep the magnetic valve $V_1$ open due to an electromotive force of the thermocouple TC. More particularly, when the thermocouple TC is heated by the pilot flame c, it creates the electromotive force which then excites the solenoid M of the safety solenoid valve unit MV causing the attraction side 8 to draw the attraction plate 7 and thus open the magnetic valve $V_1$ linked to the attraction plate 7.

When the pressing of the ignition knob 1 is canceled with the magnetic valve $V_1$ being opened, the ignition operating shaft 2 and the distal end extension 4 return back to their original position with the ignition knob 1 kept to the "pilot" position due to the yielding force of the return spring 9. At the time, the pilot valve $V_2$ is opened by the action of the pilot valve cam 3*b* of the cam body 3 and the pilot burner PB remains in combustion action. This permits the thermocouple TC to be continuously heated hence maintaining the magnetic valve $V_1$ opened.

Then, the ignition knob 1 is released from being pressed and, turned to open a plunger valve $V_3$ for enabling the supply of gas to a main burner MB. More specifically, when the ignition knob 1 is turned under pressure from the "pilot" position to the "open" position counter-clockwisely through a given angle b (about 90 degrees), the cam body 3 linked to the ignition operating shaft 2 rotates to open the valve unit $V_3$ with its valve unit cam 3*a* as resisting against the yielding force of a closing spring 14, allowing the gas to run from the gas inlet 5*a* of the gas passage 5 via the magnetic valve $V_1$, the valve unit $V_3$ and a snap valve $V_5$ to the main burner MB while being controlled by the governor valve unit GV to a desired stable pressure corresponding to the amount of flow, which will be explained later. The main burner MB is then ignited by the pilot flame c to produce a main flame d.

The governor valve unit GV is arranged in which its diaphragm 15 when urged by a secondary gas pressure moves and drives a gas valve $V_4$ until the pressure is balanced with the yielding force of a balancing spring 16, hence controlling the distance between the gas valve $V_4$ and its valve seat 17 to determine the opening of the gas passage 5. In other words, when the pressure of the gas is varied at the upstream, it is stabilized by maintaining the gas flow to be consumed uniform at the downstream. The valve seat 17 for engagement with the gas valve $V_4$ linked to the diaphragm 15 is improved in the tightness with a rubber molding 17*a* and fine polishing, hence increasing the interfacial accuracy between the gas valve $V_4$ and the valve seat 17. Also, the gas valve $V_4$ has a valve shaft 18 thereof provided with a guide slot 19 in which a stationary guide pin 20 is freely extended for allowing the movement but preventing the tilting of the gas valve $V_4$ so that the positional relationship between the gas valve $V_4$ and the valve seat 17 can correctly be maintained.

When the pilot ignition is initiated with the pilot valve $V_2$ opened, the flow of gas is supplied, for example, at 100 kilocalories/hour to the pilot burner PB. When the main ignition is initiated with the snap valve $V_5$ of a snap valve unit SV, which is actuated in response to a change in the temperature of hot water in a reservoir A described later, opened, the flow of the gas is supplied, for example, at 20 to 30 thousands kilocalories/hour, to the main burner MB. The flow of the gas can thus be controlled by the action of the governor valve unit GV in a wider range from the pilot gas supply to the main gas supply correctly and stably. Also shown are a control screw 21 for controlling the yielding force of the adjusting spring 16 and a cap 22.

The snap valve unit SV is designed for closing and opening the gas passage 5 in response to the temperature of the hot water in the reservoir A. More specifically, a sensor rod B installed in the reservoir A contracts or expands depending on the temperature of the hot water and can drive a pressing member 24 via a snap lever 23 to press or release a snap disk 25 thus opening or closing the snap valve $V_5$.

The sensor rod B incorporates a member such as an amber 27, which has a smaller rate of the linear expansivity, accommodated in a copper case 26 which has a greater rate of the linear expansivity and is thus susceptible to the temperature change in the hot water. As the copper case 26 contracts or extends depending on the temperature of the hot water, the amber 27 is advanced or retracted. The snap disk 25 is a biased spring which can automatically return back to one side (to close the snap valve $V_5$). The snap disk 25 is pressed at outer edge with the pressing member 24. A temperature adjusting screw 28 is provided supporting the proximal end of the snap lever 23 and acting as a fulcrum of the pivoting action of the snap lever 23. The temperature adjusting screw 28 is used to control the urging force of the pressing member 24 against the snap disk 25 in relation with the expansion of the amber 27, hence determining the time required for opening and closing the snap valve $V_5$ to have a desired level of the hot water temperature.

When the hot water in the reservoir A drops down below a setting temperature, the copper case 26 of the sensor rod B contracts proportionally and causes the amber 27 to advance (move leftward in the figure) and press the snap lever 23 which is then swung about the fulcrum of the temperature adjusting screw 28. As the pressing member 24 is urged by the distal end of the snap lever 23, it presses the snap disk 25 as resisting against the yielding force of the snap disk 25 until the snap disk 25 is biased to the reverse side (as denoted by the chain line in FIG. 1). This drives the snap valve $V_5$ to move leftward to its open position as resisting against the yielding force of a return spring 29, hence opening the gas passage 5 to the main burner MB. As the main burner MB is supplied with the gas and ignited with the pilot flame c which has been initiated, its main flame d can heat up a convection type heat collector (not shown) to increase the temperature of the hot water in the reservoir A.

When the hot water in the reservoir A is heated by the combustion of the main burner MB to a desired temperature, the copper case 26 of the sensor rod B expands and causes the amber 27 to retract (move rightward in the figure). As the pressing action of the snap lever 23 against the snap disk 25 is canceled, the snap disk 25 itself springs back to the original position as shown in FIG. 1 and the snap valve $V_5$ is moved rightward by the yielding force of the return spring 29 to its closing position. As a result, the gas passage to the main burner MB is shut off, thus stopping the supply of the gas to the main burner MB and extinguishing the main flame d in the main burner MB.

In that manner, the temperature of the hot water in the reservoir A can be maintained to a constant level. Also shown is a thermal fuse F provided in an electromagnetic circuit for fusing down itself to close the magnetic valve $V_1$ and cancel the supply of the gas when the hot water temperature in the reservoir A rises up to an abnormal level.

When the ignition knob 1 is depressed and turned from the "stop" position to the "pilot" position, the pilot burner PB produces the pilot flame c. Then, when the ignition knob 1 is released and turned further from the "pilot" position to the "open" position, the boiler is in its standby state. Thereafter, the action of the sensor rod B installed in the reservoir A for checking the temperature of the hot water causes the snap valve unit SV to open and close the gas passage 5 to the main burner MB for automatically controlling the combustion and its cancellation in the main burner MB. Accordingly, the temperature of the hot water in the reservoir A can be maintained to a constant level. Also, when the ignition knob 1 is reversed from the "open" position to the "stop" position, the pilot valve $V_2$ and the plunger valve $V_3$ are closed to extinguish the pilot flame c and thus cancel the heating of the thermocouple TC. This eliminates the electromotive force of the thermocouple TC thus closing the magnetic valve $V_1$. Meanwhile, the governor valve unit GV mounted across the gas passage 5 is carefully designed so that the interfacial accuracy between the gas valve $V_4$ and the valve seat 17 is improved and the gas valve $V_4$ is prevented from tilting. Accordingly, the flow of the gas can be controlled by the governor valve unit GV within a wider range from the pilot supply to the main supply. In addition, the temperature of the hot water in the reservoir A can automatically be controlled with a combination of the sensor rod B and the snap valve unit SV.

Also, since the action of the magnetic valve $V_1$ is controlled with the pilot burner PB, unwanted decrease in the electromotive force caused by increase with time of the resistance in the electromagnetic circuit will be avoided. It is desirable for improving the safety, e.g. eliminating inferior ventilation (loss of oxygen), to synchronize the closing of the magnetic valve by extinguishing the pilot flame with an imperfect combustion protecting scheme.

It would be understood that the present invention is not limited to the embodiment described above and other modifications and changes may be made without departing from the scope of the present invention.

The present invention is embodied in the from described above, providing the following effects.

The control valve for a vessel gas water heater defined in claim 1 of the present invention, which is arranged in that the ignition knob is pressed and turned for opening the magnetic valve and igniting the pilot burner, the magnetic valve is maintained open by the electromotive force of the thermocouple heated with the pilot flame, and then the ignition knob is released from being pressed and is turned further for opening the plunger valve to enable the supply of gas to the main burner and thus set the standby state while the sensor rod is provided for contracting and expanding depending on the temperature of hot water in the reservoir to open and close the snap valve and thus proceed and cancel the combustion in the main burner for automatically controlling the temperature of the hot water in the reservoir to a desired level, is characterized by the single governor valve unit arranged in that the positional relationship between its valve and valve seat is correctly maintained so that the supply of the gas is constantly flown corresponding to the requirement for the pilot supply and the main supply which ranges widely from the pilot supply to the main supply. As a result, the control valve of the present invention will be simplified in the construction and reduced in the production cost as compared with any conventional two-governor type.

The control valve for a vessel gas water heater defined in claim 2 of the present invention has the governor valve arranged in that the interfacial accuracy between the valve and the valve seat is improved and the valve is prevented from tilting, hence allowing the single governor valve unit to control throughout a wider range of the flow of the gas from the pilot supply to the main supply. Accordingly, the control valve defined in claim 1 can be implemented with much ease.

The control valves for a vessel gas water heater defined in claims 3 and 4 are arranged in which the valve seat for the valve is increased in the seating tightness using the rubber molding and the fine polishing and in which the valve is prevented from tilting by the guide pin freely fitted in the shaft of the valve, hence allowing the positional relationship between the valve and the valve seat to be correctly maintained. Accordingly, the control valve defined in claim 1 or 2 can be implemented with much ease.

The control valve for a vessel gas water heater defined in claim 5 is modified in which the pilot burner is a constantly flaming type pilot burner designed for also heating the thermocouple, allowing the magnetic valve to be closed by extinguishing the pilot flame. Accordingly, such a disadvantage that the electromagnetic force is declined due to the increase with time of the resistance in the magnetic circuit equipped with an electric switch can be eliminated thus improving the safety.

What is claimed is:

1. A control valve for a vessel gas water heater having an ignition knob pressed and turned for opening a magnetic valve and igniting a pilot burner, the magnetic valve maintained open by an electromotive force of a thermocouple heated with a pilot flame, and then, the ignition knob released from being pressed, and turned further for opening a plunger valve to enable the supply of gas to a main burner, and having a sensor rod for contracting and expanding depending on the temperature of hot water in a reservoir to open and close a snap valve and thus proceed and cancel the combustion in the main burner for automatically controlling the temperature of the hot water in the reservoir to a desired level, characterized by:

a single governor valve unit arranged in that the positional relationship between a valve and a valve seat of said single governor valve unit is correctly maintained to have a wide range of the flow of gas from a pilot supply to a main supply, thus enabling stable control over both the flow of gas to the main burner and the flow of gas to the pilot burner.

2. A control valve for a vessel gas water heater according to claim 1, wherein the governor valve is also arranged in that the interfacial accuracy between the valve and the valve seat is improved and the valve is prevented from tilting.

3. A control valve for a vessel gas water heater according to claim 1, wherein the valve seat for the valve is increased in the seating tightness using a rubber molding and fine polishing.

4. A control valve for a vessel gas water heater according to claim 1, wherein the valve is prevented from tilting by a guide pin freely fitted in a shaft of the valve.

5. A control valve for a vessel gas water heater according to claim 1, wherein the pilot burner is a constantly flaming type pilot burner designed for also heating a thermocouple.

6. A control valve for a vessel gas water heater according to claim 2, wherein the valve seat for the valve is increased in the seating tightness using a rubber molding and fine polishing.

7. A control valve for a vessel gas water heater according to claim 2, wherein the valve is prevented from tilting by a guide pin freely fitted in a shaft of the valve.

* * * * *